US010030542B2

(12) United States Patent
Zurmehly et al.

(10) Patent No.: US 10,030,542 B2
(45) Date of Patent: Jul. 24, 2018

(54) COMPLIANT COUPLING SYSTEMS AND METHODS FOR SHROUDS

(71) Applicant: HONEYWELL INTERNATIONAL INC., Morristown, NJ (US)

(72) Inventors: Ed Zurmehly, Phoenix, AZ (US); David R. Waldman, Chandler, AZ (US); Deanna Pinar Chase, Tempe, AZ (US); David K Jan, Fountain Hills, AZ (US); Gregory Ockenfels, Phoenix, AZ (US); Alonso Peralta-Duran, Avondale, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 346 days.

(21) Appl. No.: 14/873,853

(22) Filed: Oct. 2, 2015

(65) Prior Publication Data

US 2017/0096911 A1 Apr. 6, 2017

(51) Int. Cl.

| | |
|---|---|
| ***F01D 25/24*** | (2006.01) |
| ***F01D 9/02*** | (2006.01) |
| ***F01D 11/00*** | (2006.01) |

(52) U.S. Cl.

CPC ..... *F01D 25/246* (2013.01); *F01D 9/02* (2013.01); *F01D 11/005* (2013.01); *F05D 2220/32* (2013.01); *F05D 2230/60* (2013.01)

(58) Field of Classification Search

CPC ..... F01D 25/246; F01D 9/02; F01D 11/005; F05D 2230/60; F05D 2220/32

See application file for complete search history.

(56) References Cited

U.S. PATENT DOCUMENTS 2,915,281 A * 12/1959 Ridley ..... F01D 9/042 415/209.1
3,966,023 A * 6/1976 Huang ..... F01D 25/243 188/381

(Continued)

FOREIGN PATENT DOCUMENTS

EP 1707749 A2 * 10/2006 ..... F01D 9/04
EP 2543825 A2 1/2013

OTHER PUBLICATIONS

Extended EP Search Report for Application No. 16191994.9-1610/3159502 dated Mar. 29, 2017.

(Continued)

*Primary Examiner* — Eldon Brockman
(74) *Attorney, Agent, or Firm* — Lorenz & Kopf, LLP

(57) ABSTRACT

Compliant coupling systems and methods are provided for coupling a shroud to an engine casing. The complaint coupling system includes a retaining ring adapted to be positioned adjacent to the shroud and adapted to be coupled to the engine casing. The retaining ring defines a coupling channel about a circumference of the retaining ring and at least one notch that interrupts the coupling channel. The complaint coupling system also includes a first clip received within the coupling channel. The first clip has a biasing portion that extends into a space defined by the at least one notch, and the biasing portion is adapted to contact the shroud. The complaint coupling system includes a second clip received within the coupling channel. The second clip has a bumper portion that extends into the spaced defined by the at least one notch, and the bumper portion is adapted to contact the shroud.

18 Claims, 13 Drawing Sheets

(56) References Cited

U.S. PATENT DOCUMENTS 5,232,340 A * 8/1993 Morgan ..... F01D 9/042 415/190
5,320,487 A * 6/1994 Walker ..... C30B 11/00 415/173.3
5,971,703 A * 10/1999 Bouchard ..... F01D 25/246 415/135
7,195,452 B2 3/2007 Allan et al.
7,762,768 B2 7/2010 Shi et al.
8,079,807 B2 * 12/2011 Shapiro ..... F01D 25/246 415/173.1
8,167,546 B2 * 5/2012 Shi ..... F01D 9/04 415/173.1
8,172,522 B2 * 5/2012 Shapiro ..... F01D 9/042 415/189
8,511,975 B2 8/2013 Shi et al.
8,684,689 B2 4/2014 Guo et al.
9,051,846 B2 * 6/2015 Arilla ..... F01D 9/04
9,194,299 B2 * 11/2015 Alarcon ..... F01D 21/045
2006/0067813 A1 3/2006 Allan et al.
2006/0216143 A1 * 9/2006 Trinks ..... F01D 9/04 415/173.1
2009/0246014 A1 * 10/2009 Shapiro ..... F01D 9/042 415/209.3
2010/0232941 A1 9/2010 Smoke et al.
2011/0052384 A1 * 3/2011 Shi ..... F01D 9/04 415/200
2011/0189009 A1 * 8/2011 Shapiro ..... F01D 11/12 415/209.3
2011/0236203 A1 * 9/2011 Arilla ..... F01D 9/04 415/213.1
2013/0011253 A1 * 1/2013 Mulcaire ..... F01D 25/243 415/214.1
2013/0052074 A1 2/2013 Durocher et al.
2014/0173897 A1 * 6/2014 Alarcon ..... F01D 21/045 29/888.025

OTHER PUBLICATIONS

Dean A. et al, "Design and Testing of CFCC Shroud and Combustor Components FREE," ASME 1999 International Gas Turbine and Aeroengine Congress and Exhibition, Jun. 7-10, 1999.

* cited by examiner

COMPLIANT COUPLING SYSTEMS AND METHODS FOR SHROUDS

TECHNICAL FIELD

The present disclosure generally relates to compliant coupling systems and methods, and more particularly relates to compliant coupling systems and methods for coupling a shroud to an engine casing.

BACKGROUND

Compressor or turbine rotor blade stages in gas turbine engines may be provided with shrouds that maintain clearances between the tips of the rotor blades and the shrouds over a wide range of rotor speeds and temperatures. In certain instances, the shrouds may thermally expand or grow radially at a different rate than the engine casing. Depending on how the shroud is coupled to the engine casing, the difference between the thermal growth rates may result in misalignment between the shroud and the tips of the rotor blades, which reduces efficiency of the compressor or turbine. Moreover, depending upon how the shroud is coupled to the engine casing, stresses may arise in the shroud and/or the engine casing due to the difference in the thermal growth rates.

Accordingly, it is desirable to provide an improved coupling system and method for coupling a shroud to an engine casing, which provides radial compliance and reduces stresses due to differences in thermal growth rates. Moreover, it is desirable to provide a complaint coupling system and method, which reduces manufacturing costs. Furthermore, other desirable features and characteristics of the present invention will become apparent from the subsequent detailed description and the appended claims, taken in conjunction with the accompanying drawings and the foregoing technical field and background.

SUMMARY

According to various embodiments, provided is a compliant coupling system for coupling a shroud to an engine casing. The complaint coupling system includes a retaining ring adapted to be positioned adjacent to the shroud and adapted to be coupled to the engine casing. The retaining ring defines a coupling channel about a circumference of the retaining ring and at least one notch that interrupts the coupling channel. The complaint coupling system also includes a first clip received within the coupling channel. The first clip has a biasing portion that extends into a space defined by the at least one notch, and the biasing portion is adapted to contact the shroud. The complaint coupling system includes a second clip received within the coupling channel. The second clip has a bumper portion that extends into the spaced defined by the at least one notch, and the bumper portion is adapted to contact the shroud.

Also provided according to various embodiments is a method for coupling a shroud to an engine casing. The method includes coupling a retaining ring defining at least three notches to the engine casing, each of the at least three notches defining a space, and coupling a first clip to the retaining ring such that a portion of the first clip extends into the space defined by a respective one of the at least three notches. The method also includes coupling a second clip to the retaining ring such that a portion of the second clip extends into the space defined by the respective one of the at least three notches. The method includes coupling the shroud including at least three tabs to the retaining ring such that each of the at least three tabs is substantially aligned with a respective one of the at least three notches and a respective one of the at least three tabs is coupled to the portion of the first clip and the portion of the second clip.

Provided according to various embodiments is a gas turbine engine. The gas turbine engine includes an engine casing and an annular shroud received within the engine casing. The shroud includes at least one tab extending axially from the shroud. The gas turbine engine includes a compliant coupling system that couples the shroud to the engine casing. The complaint coupling system includes a retaining ring defining a coupling channel about a circumference of the retaining ring and at least one notch that interrupts the coupling channel. The retaining ring is coupled to the engine casing adjacent to the shroud such that the at least one tab is received in a space defined by the at least one notch. The complaint coupling system also includes a first clip having a first base and a biasing portion coupled to the first base. A portion of the first base is received within the coupling channel such that the biasing portion extends into the space defined by the at least one notch and contacts the at least one tab. The complaint coupling system includes a second clip having a second base and a bumper portion coupled to the second base. A portion of the second base is received within the coupling channel such that the bumper portion extends into the spaced defined by the at least one notch and contacts the at least one tab.

DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description. Moreover, while the compliant coupling system is described herein as being used with a gas turbine engine, it will be understood that the various teachings of the present disclosure may be employed with any suitable structure in which it is desired to couple two items together with radial compliance, such as parts composed of materials with different thermal growth rates. In addition, while the present disclosure is described herein as coupling a shroud to an engine casing for a stage of the gas turbine engine, the various teachings of the present disclosure are not so limited. In this regard, the compliant coupling system of the present disclosure may be employed to couple together any suitable components where it is desired to provide radial compliance. Further, it should be noted that many alternative or additional functional relationships or physical connections may be present in an embodiment of the present disclosure. In addition, while the figures shown herein depict an example with certain arrangements of elements, additional intervening elements, devices, features, or components may be present in an actual embodiment. It should also be understood that the drawings are merely illustrative and may not be drawn to scale.

Figure 1:
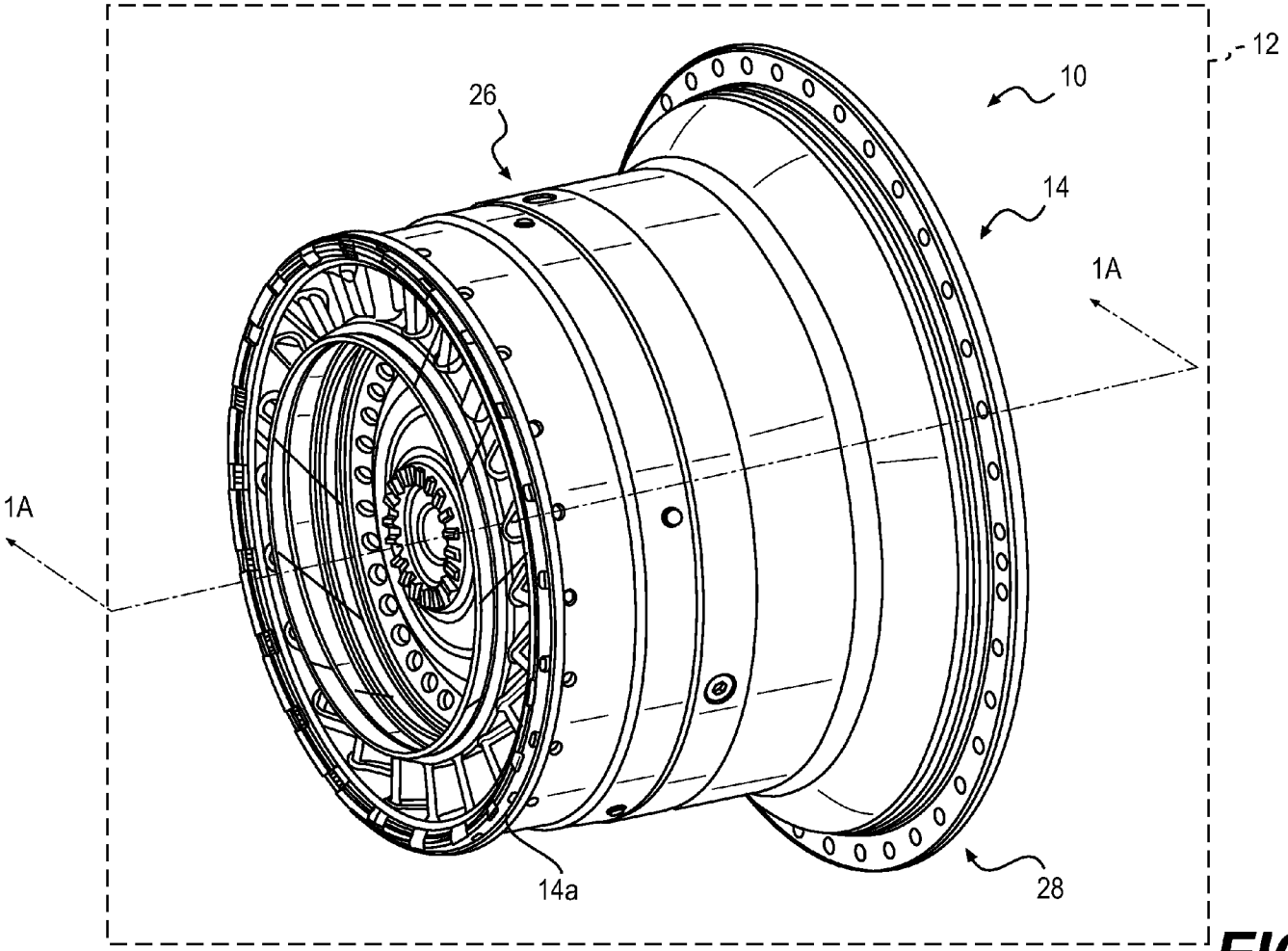
FIG. 1 is a perspective view of a compressor or turbine of a gas turbine engine, which includes a compliant coupling system for coupling a shroud to an engine casing in accordance with various embodiments.
Figure 1A:
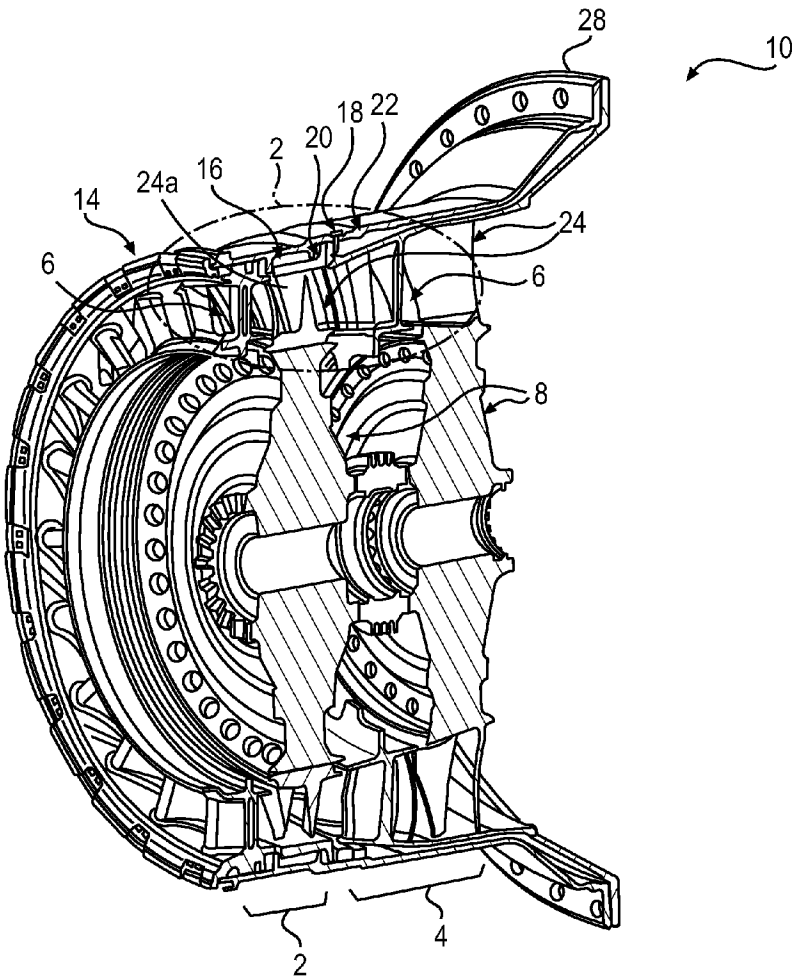
FIG. 1A is a cross-sectional view of the compressor or turbine of FIG. 1, taken along line 1A-1A of FIG. 1.
Figure 1B:
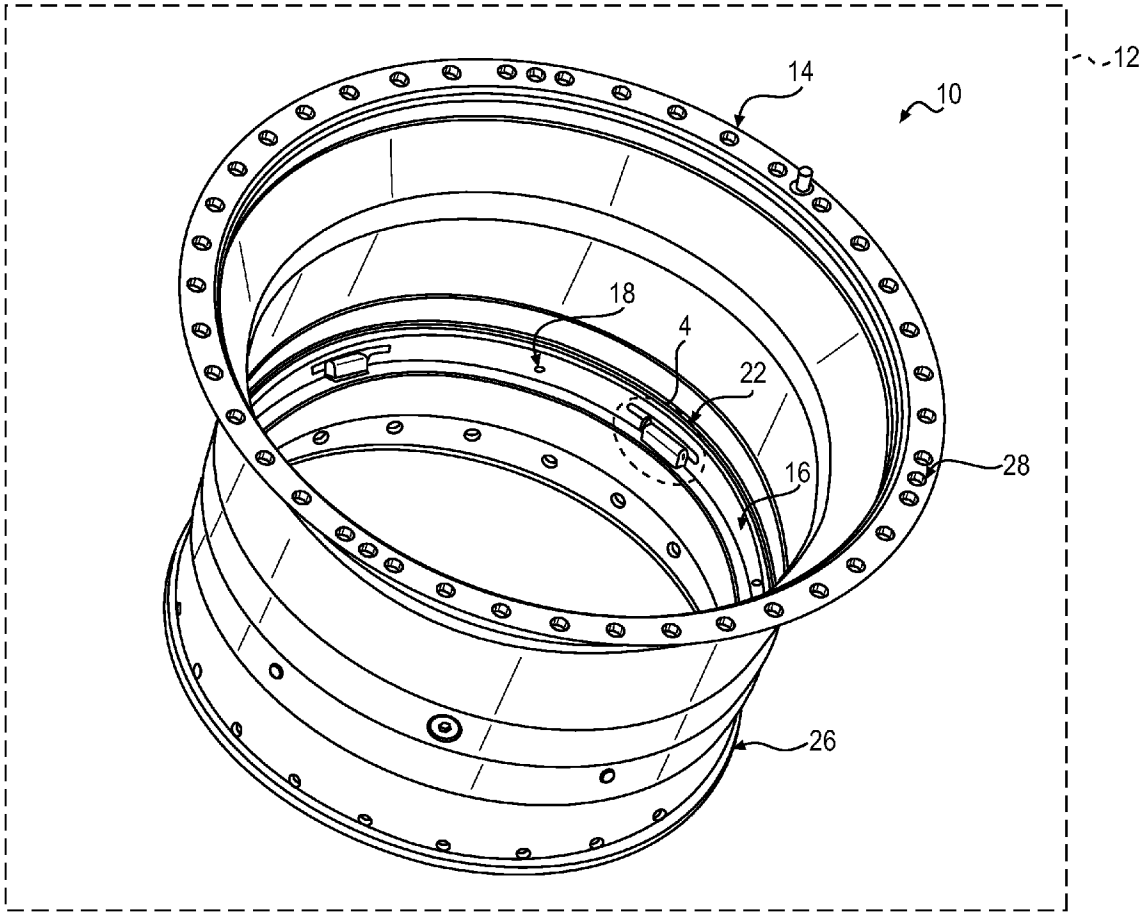
FIG. 1B is a perspective view of the compressor or turbine of FIG. 1, in which one or more nozzles and one or more rotors associated with the compressor or turbine have been removed for clarity.
Figure 2:
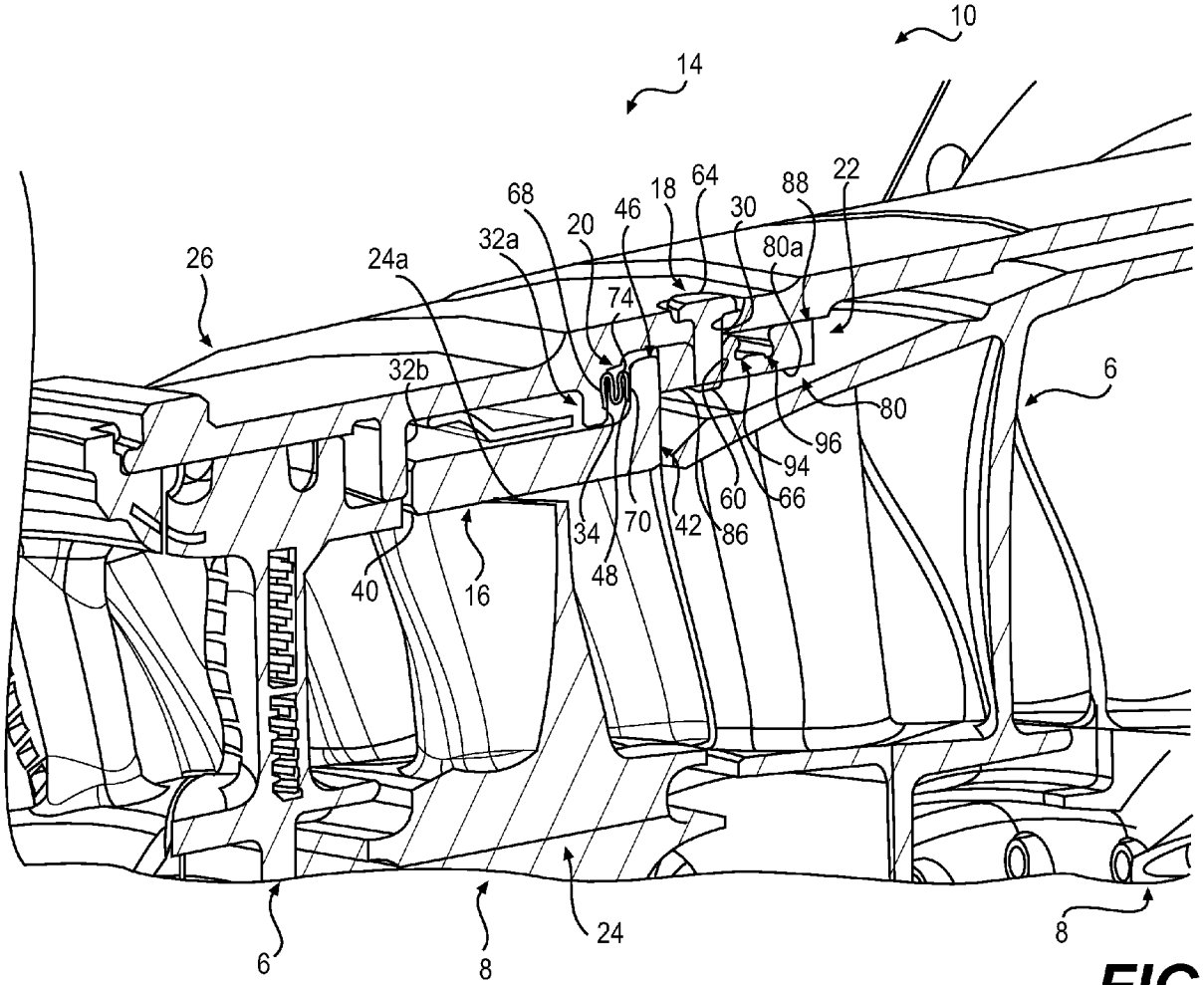
FIG. 2 is a detail view of a portion of the compressor or turbine of FIG. 1A.

With reference to FIGS. 1-2, a portion of a compressor or turbine 10 of a gas turbine engine 12 is shown. In one example, the compressor or turbine 10 includes a support or engine casing 14, a shroud 16 (FIGS. 1A and 2), one or more anti-rotation pins 18 (FIGS. 1A and 2), a seal 20 (FIGS. 1A and 2) and a compliant coupling system 22 (FIGS. 1A, 1B and 2). In this example, the engine casing 14 encloses a first stage 2 and a second stage 4 of a high pressure turbine. With reference to FIGS. 1 and 1A, each of the first stage 2 and the second stage 4 include one or more vanes, stators or nozzles 6 and one or more rotors 8. The one or more nozzles 6 are positioned adjacent to a respective one of the one or more rotors 8 to change a fluid pressure of fluid received from the respective one of the one or more rotors 8. The one or more rotors 8 are rotatable about a suitable rotating assembly, as known to one of skill in the art, to change a fluid pressure of a fluid. Generally, each of the one or more rotors 8 includes a plurality of rotor blades 24, which are each coupled to a hub and movable about a rotational axis to increase or decrease a fluid pressure.

According to various embodiments, with reference to FIG. 2, the shroud 16 is positioned about at least one of the plurality of rotor blades 24 at a predefined distance from tips 24*a* of each of the rotor blades 24 with the compliant coupling system 22. It should be noted that while the shroud 16 is illustrated herein as being positioned about the first stage 2 of the axial compressor or turbine 10, the shroud 16 may be positioned via the compliant coupling system 22 about any stage of the axial compressor or turbine 10. As will be discussed, the compliant coupling system 22 couples the shroud 16 to the engine casing 14 and provides radial compliance, which minimizes stresses in the engine casing 14 and the shroud 16.

Figure 3:
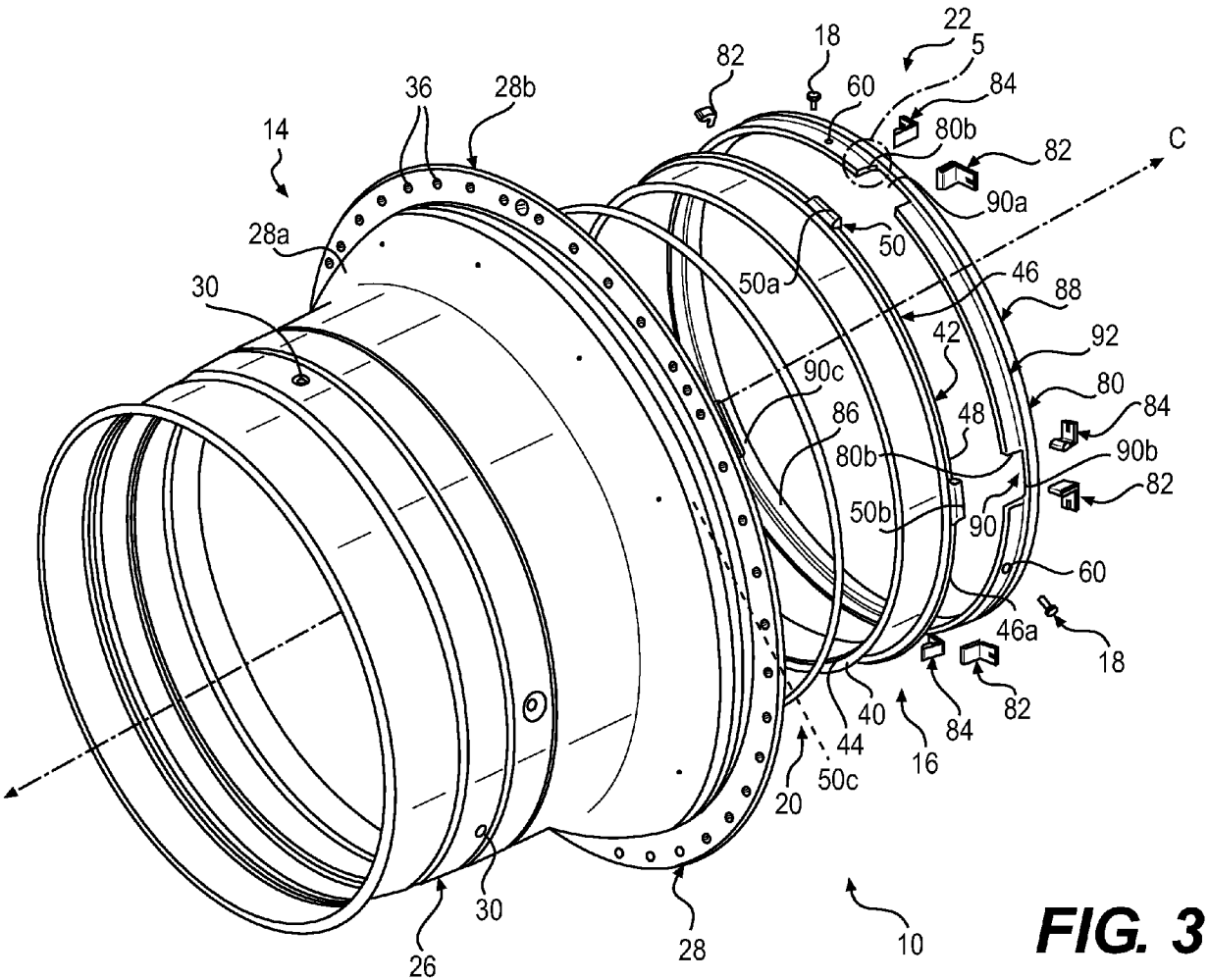
FIG. 3 is an exploded view of FIG. 1B.

The engine casing 14 substantially surrounds and encloses the shroud 16. The engine casing 14 may be composed of any suitable material, such as a metal, metal alloy, composite, etc. In one example, the engine casing 14 is composed of a metal or metal alloy. The engine casing 14 defines a throughbore 14*a* (FIG. 1), which extends through an entirety of the engine casing 14 to receive the shroud 16, the seal 20 and the compliant coupling system 22. Generally, the shroud 16, the seal 20 and a portion of the compliant coupling system 22 are arranged within the engine casing 14 so as to be concentric with the engine casing 14. The engine casing 14 includes a body 26 and a flange 28. In one example, the engine casing 14 substantially surrounds a perimeter of the shroud 16 such that an entirety of the shroud 16 is contained within the body 26. In this example, the body 26 is substantially cylindrical; however, body 26 may have any desired shape. The body 26 defines one or more alignment bores 30 (FIG. 3). The alignment bores 30 are generally spaced circumferentially apart along the body 26. The alignment bores 30 are each sized and shaped to receive a respective one of the one or more anti-rotation pins 18. In one example, the body 26 defines three alignment bores 30; however, the body 26 may define any desired number of alignment bores 30 to assist in inhibiting the rotation of the shroud 16 relative to the engine casing 14, as will be discussed below. Other embodiments may use features added to the engine casing 14 to perform the alignment and anti-rotation functions, and thus, the use of the alignment bores 30 is merely an example.

With reference to FIG. 2, the body 26 may also define one or more internal flanges 32. The one or more internal flanges 32 extend radially inward from the body 26; towards an axial centerline C of the body 26 (FIG. 3). In one example, the body 26 defines at least a first internal flange 32*a* and a second internal flange 32*b*. In this example, the first internal flange 32*a* extends for a distance that is different than the second internal flange 32*b*. The first internal flange 32*a* provides a surface 34, against which a portion of the seal 20 seats to reduce a leakage of fluid around the shroud 16. The second internal flange 32*b* is disposed adjacent to the shroud 16, and is spaced axially apart from the first internal flange 32*a*.

With reference to FIG. 3, the flange 28 couples the engine casing 14 to an adjacent portion or stage of the gas turbine engine 12. In one example, the flange 28 extends outwardly from the body 26. The flange 28 includes a first end 28*a* coupled to the body 26 and a second end 28*b*. The flange 28 may have an increasing or positive slope from the first end 28*a* to the second end 28*b*. The second end 28*b* may define one or more bores 36 spaced apart along a perimeter or circumference of the second end 28*b* to couple the engine casing 14 to the adjacent structure of the gas turbine engine 12.

The shroud 16 is coupled to the engine casing 14 via the compliant coupling system 22. The shroud 16 may be composed of any suitable material, such as a metal, metal alloy, composite, etc. In one example, the shroud 16 is composed of a ceramic based material, which may have a thermal growth rate that is different than a thermal growth rate associated with the engine casing 14. The shroud 16 is substantially annular, and includes a first end 40 and a second end 42. The shroud 16 also defines a throughbore 44 through an entirety of the shroud 16 from the first end 40 to the second end 42. The first end 40 is adjacent to the second internal flange 32*b* when the shroud 16 is positioned in the engine casing 14.

The second end 42 of the shroud 16 includes a projecting flange 46. With reference to FIGS. 2 and 3, the projecting flange 46 extends radially outward from the second end 42 of the shroud 16 for a length greater than a length of the first internal flange 32*a*. The projecting flange 46 defines a surface 48 and includes three or more tabs 50 (FIG. 3). The surface 48 is defined substantially about a perimeter or circumference of the projecting flange 46. The surface 48 provides a seat for a portion of the seal 20, such that the seal 20 is received between and seals against the projecting flange 46 and the first internal flange 32*a* as will be discussed herein.

With reference to FIG. 3, the three or more tabs 50 are spaced about a perimeter or circumference of the projecting flange 46. In one example, the three or more tabs 50 extend from a surface 46*a* of the projecting flange 46 opposite the surface 48. The three or more tabs 50 generally extend axially from the shroud 16 or outward from the surface 46*a* such that the three or more tabs 50 each extend along an axis, which is substantially parallel to the centerline C. In one example, the shroud 16 comprises at least three tabs 50*a*, 50*b*, 50*c*, but the shroud 16 may comprise any number of tabs 50, such as five, seven or more. Generally, the shroud 16 comprises at least three tabs 50*a*, 50*b*, 50*c* to ensure concentricity of the shroud 16 within the engine casing 14. Generally, each of the three or more tabs 50 has substantially the same shape, however, it should be understood that one or more of the tabs 50 may have a different shape, if desired.

Figure 4:
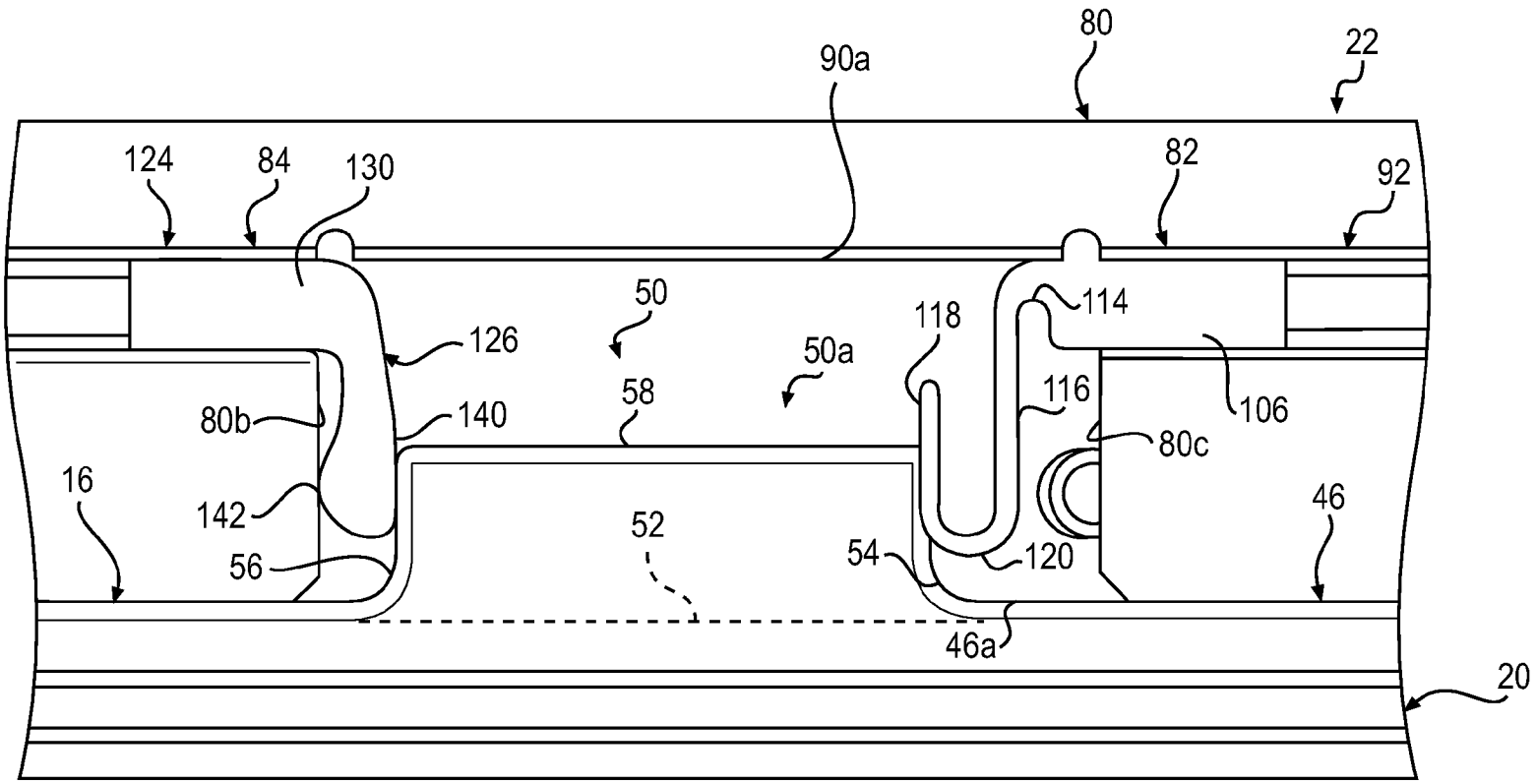
FIG. 4 is a detail view of the compliant coupling system from detail 4 of FIG. 1B.

With reference to FIG. 4, an exemplary one of the three or more tabs 50 is shown. In this example, the tab 50*a* includes a base 52, a first surface 54, a second surface 56 and a top surface 58. The base 52 couples the tab 50*a* to the projecting flange 46. The first surface 54 and the second surface 56 extend upwardly from the base 52 or axially relative to the centerline C (FIG. 3). The first surface 54 is generally opposite the second surface 56. The first surface 54 and the second surface 56 each cooperate with a portion of the compliant coupling system 22 to couple the shroud 16 to the engine casing 14. The top surface 58 is generally opposite the base 52, and is coupled to the first surface 54 and the second surface 56.

With reference to FIGS. 2 and 3, the one or more anti-rotation pins 18 prevent or inhibit the rotation of the shroud 16 relative to the engine casing 14. The one or more anti-rotation pins 18 are spaced circumferentially about the engine casing 14, and are each received in a respective one of the alignment bores 30. The one or more anti-rotation pins 18 are each also received in a respective one of a plurality of bores 60 associated with a portion of the compliant coupling system 22. The one or more anti-rotation pins 18 may be composed of any suitable material, such as a metal, metal alloy, composite, etc. In one example, the one or more anti-rotation pins 18 comprises three pins 18, however, any number of pins 18 may be employed between the engine casing 14 and compliant coupling system 22 to prevent the rotation of the shroud 16 relative to the engine casing 14. With reference to FIG. 2, each of the one or more anti-rotation pins 18 comprises a head 64 and a shaft 66. The head 64 is sized to bear against a portion of the engine casing 14 adjacent to the coupling bore 30, and the shaft 66 is received through the coupling bore 30 of the engine casing 14 and the bore 60 of the compliant coupling system 22.

The seal 20 is coupled between the shroud 16 and the engine casing 14. The seal 20 prevents or inhibits the leakage of fluid, such as air, about the shroud 16. In this regard, any flow of fluid about an exterior of the shroud 16, between the shroud 16 and the engine casing 14, reduces a performance and efficiency of the turbine. In one example, the seal 20 comprises a baffle or W-shape; however, the seal 20 may have any desired shape, such as an X-shape, O-shape, U-shape, etc. The seal 20 may be composed of any suitable material, such as a metal, metal alloy, etc. In this example, the seal 20 is composed of a metal. Generally, the seal 20 includes a first sealing surface 68 and a second sealing surface 70. The first sealing surface 68 is separated from the second sealing surface 70 via a body 74. The first sealing surface 68 seats or seals against the surface 34 of the first internal flange 32*a*, and the second sealing surface 70 seats or seals against the surface 48 of the projecting flange 46. The body 74 defines one or more undulations, which may be compressed upon insertion of the seal 20 into the engine casing 14 to bias the seal 20 between the first internal flange 32*a* and the projecting flange 46. It should be noted that while the seal 20 is illustrated and described herein as comprising an energized seal, the seal 20 may include a separate energizer, if desired.

The compliant coupling system 22 couples the shroud 16 to the engine casing 14. In one example, the compliant coupling system 22 includes a retaining ring 80, a plurality of first, biasing clips 82 and a plurality of second, bumper clips 84. The retaining ring 80, the first, biasing clips 82 and the second, bumper clips 84 cooperate to secure the shroud 16 to the engine casing 14 axially to enable radial compliance between the shroud 16 and the engine casing 14.

The retaining ring 80 is annular and concentric with the engine casing 14. The retaining ring 80 is received within the engine casing 14, and is coupled to the engine casing 14 via the one or more anti-rotation pins 18. The retaining ring 80 is composed of a suitable metal, metal alloy, composite, etc. In one example, the retaining ring 80 is composed of a metal alloy. The retaining ring 80 includes a first side 86, a second side 88, three or more notches 90 and the plurality of bores 60. A throughbore 80*a* is also defined through the retaining ring 80, which enables the retaining ring 80 to be positioned about the plurality of rotor blades 24 (FIG. 2). The plurality of bores 60 are defined through the first side 86 to the second side 88 to receive respective ones of the one or more anti-rotation pins 18. The plurality of bores 60 are generally cylindrical, however, the plurality of bores 60 may have any desired shape to cooperate with the one or more anti-rotation pins 18.

The first side 86 comprises an inner diameter of the retaining ring 80, and thus, defines an inner diameter surface 86*a*. The first side 86 is adjacent to the plurality of rotor blades 24 when the retaining ring 80 is coupled to the engine casing 14 (FIG. 2). The second side 88 comprises the outer diameter of the retaining ring 80. The second side 88 includes or defines a coupling channel 92 (FIG. 3). The coupling channel 92 receives a respective one of the first, biasing clips 82 and the second, bumper clips 84. Generally, the coupling channel 92 is defined adjacent to the one or more notches 90 and the plurality of bores 60.

Figure 5:
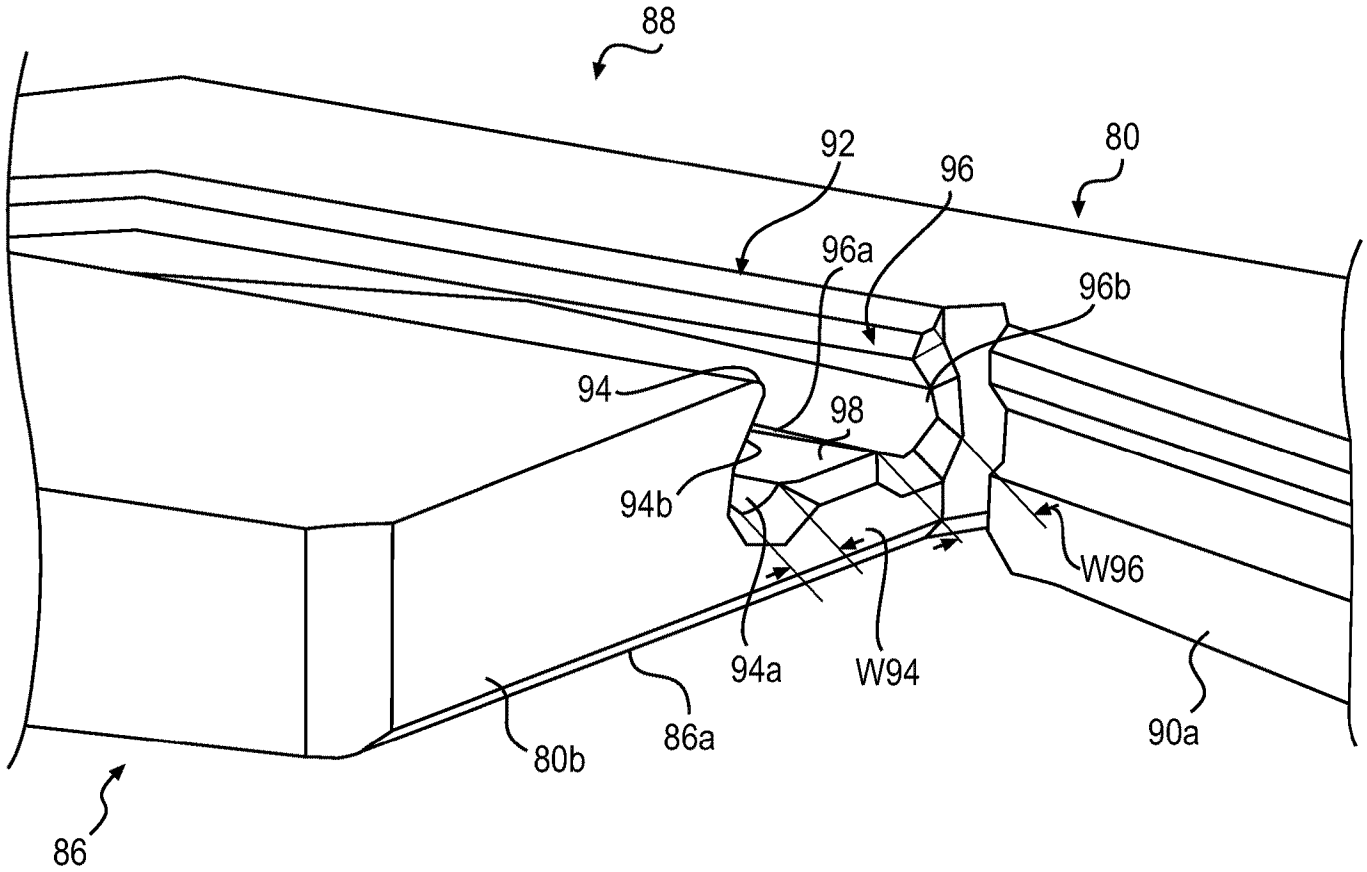
FIG. 5 is a detail view of a portion of the compliant coupling system from detail 5 of FIG. 3.

With reference to FIG. 5, the coupling channel 92 includes a first coupling groove 94, a second coupling groove 96 and a raised surface 98. The first coupling groove 94, the second coupling groove 96 and the raised surface 98 cooperate to define a substantially W-shape, which is configured to receive a portion of the first, biasing clips 82 and the second, bumper clips 84. The first coupling groove 94 may have a cross-sectional width W94 and the second coupling groove 96 may have a cross-sectional width W96. The first coupling groove 94 has a rounded surface 94*a*, and a rounded or curved sidewall 94*b*. The rounded surface 94*a* and the curved sidewall 94*b* cooperate to receive a portion of a respective one of the first, biasing clips 82 and the second, bumper clips 84. The rounded surface 94*a* provides for reduced resistance during the insertion of the respective one of the first, biasing clips 82 and the second, bumper clips 84 into the coupling channel 92.

The second coupling groove 96 has a rounded surface 96*a*, and a rounded or curved sidewall 96*b*. The rounded surface 96*a* and the curved sidewall 96*b* cooperate to receive a portion of a respective one of the first, biasing clips 82 and the second, bumper clips 84. The rounded surface 96*a* provides for reduced resistance during the insertion of the respective one of the first, biasing clips 82 and the second, bumper clips 84 into the coupling channel 92. The first coupling groove 94 and the second coupling groove 96 are rounded to provide clearance for edges of the first, biasing clips 82 and the second, bumper clips 84. It should be noted that the rounded surface 94*a*, 96*a* and the curved sidewall 94*b*, 96*b* are merely exemplary clearance features, as each of the first, biasing clips 82 and the second, bumper clips 84 may include features, such as fillets, to provide clearance during the insertion of the first, biasing clips 82 and the second, bumper clips 84 into the coupling channel 92. Generally, the first coupling groove 94 and the second coupling groove 96 are symmetric with respect to the raised surface 98. The raised surface 98 comprises a substantially rounded or circular surface that extends above a surface of the rounded surface 94*a* and the rounded surface 96*a*.

With reference to FIG. 3, the three or more notches 90 interrupt the coupling channel 92 about the perimeter or circumference of the retaining ring 80. In this regard, the coupling channel 92 extends substantially continuously about the perimeter or circumference of the retaining ring 80, but is interrupted by respective ones of the three or more notches 90 such that the three or more notches 90 are each in communication with the coupling channel 92. Generally, the retaining ring 80 comprises a number of notches 90 substantially equal to the number of tabs 50 of the shroud 16. Thus, the retaining ring 80 may comprise at least three notches 90*a*, 90*b*, 90*c*. It should be understood that like the three or more tabs 50, the retaining ring 80 may comprise any suitable number of notches 90, such as five, seven, etc. The three or more notches 90 are spaced about the perimeter or circumference of the retaining ring 80 and are each defined so as to be aligned with a respective one of the tabs 50 to couple the shroud 16 to the engine casing 14. The three or more notches 90 are generally defined through the retaining ring 80 to as to have a substantially rectangular shape, however, the three or more notches 90 may have any shape that enables a respective one of the tabs 50, the first, biasing clips 82 and the second, bumper clips 84 to be received within a respective one of the notches 90. Thus, each of the notches 90 defines a space, into which a respective one of the tabs 50, the first, biasing clips 82 and the second, bumper clips 84 are received.

Figure 7:
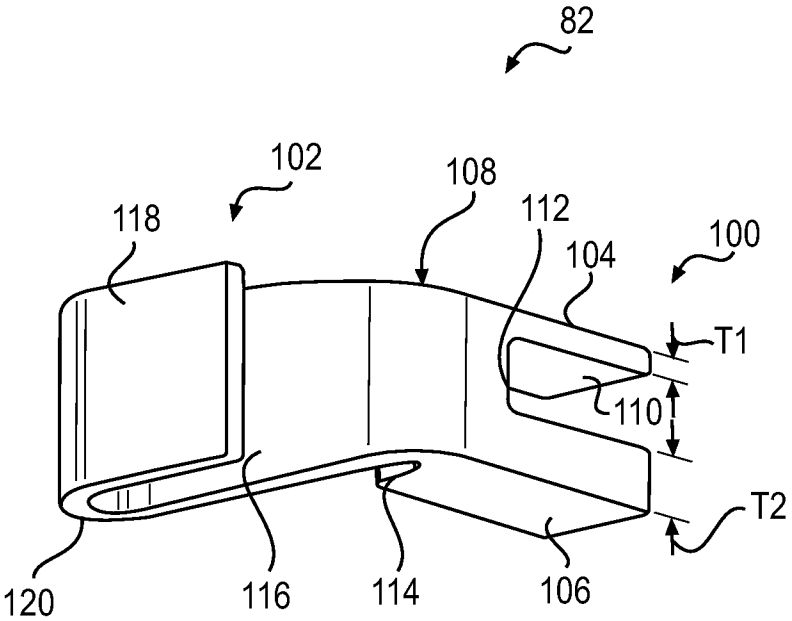
FIG. 7 is a second perspective view of the first, biasing clip.
Figure 6:
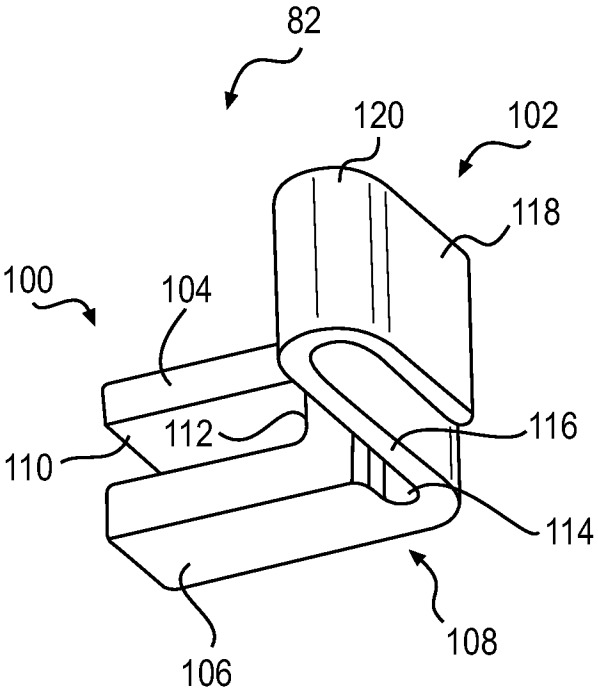
FIG. 6 is a first perspective view of a first, biasing clip of the compliant coupling system of FIG. 1 in accordance with the present disclosure.

The first, biasing clips 82 cooperate with the retaining ring 80 and a respective one of the tabs 50 to couple the shroud 16 to the engine casing 14, and to provide circumferential compliance. In this regard, each of the first, biasing clips 82 is elastically deformable, which provides circumferential compliance for the coupling of the shroud 16 to the retaining ring 80. The each of the first, biasing clips 82 also reduces contact stresses by being elastically deformable. Generally, for each one of the plurality of tabs 50 and for each one of the plurality of notches 90, there is a respective one of the first, biasing clips 82. Stated another way, a portion of a single first, biasing clip 82 is received in the coupling channel 92 and extends into the associated one of the notches 90 to bias against a respective one of the tabs 50. Each of the first, biasing clips 82 may be composed of any suitable material, such as a metal, metal alloy, etc. In one example, each of the first, biasing clips 82 is composed of a cobalt based metal alloy, and is formed through a wire electrical discharge machining (EDM) process. With reference to FIGS. 6 and 7, each of the first, biasing clips 82 includes a body 100 and a resilient portion 102.

The body 100 defines a first leg 104 and a second leg 106, which extend outwardly from a base 108. The first leg 104 may have a first thickness T1, which may be different than a second thickness T2 of the second leg 106 (FIG. 7). In one example, the first thickness T1 is less than the second thickness T2. The first leg 104 and the second leg 106 extend from the base 108 for substantially the same distance, however, one of the first leg 104 and the second leg 106 may have a different length than the other, if desired. A recess 110 is defined between the first leg 104 and the second leg 106 such that the first leg 104 is spaced apart from the second leg 106. The second leg 106 is slidably received with the inner diameter surface 86*a* of the retaining ring 80 and the first leg 104 is slidably received along the coupling channel 92 to couple the body 100 to the coupling channel 92 so that each of the first, biasing clips 82 is movable within the coupling channel 92. The recess 110 is generally sized to receive a portion of the retaining ring 80, with a wall 112 of the base 108 providing a stop that contacts the surface 80*c* of the retaining ring 80 (FIG. 4) to prevent further movement of each of the first, biasing clips 82 in the coupling channel 92. While not illustrated herein, one or more of the first leg 104 and the second leg 106 may include a radius to facilitate coupling the first leg 104 and/or second leg 106 to the coupling channel 92. Thus, the first leg 104 and the second leg 106 of the body 100 are spaced apart to receive a portion of the retaining ring 80 there between to movably couple the first, biasing clips 82 to the retaining ring 80.

The base 108 is coupled to the first leg 104, the second leg 106 and the resilient portion 102. The base 108 includes the wall 112, and a groove 114. The groove 114 serves to interconnect the resilient portion 102 with the base 108.

The resilient portion 102 is substantially U-shaped, and includes a stem 116 and a contact surface 118. The stem 116 is coupled to the groove 114 of the base 108, and extends upwardly away from the base 108. The stem 116 enables the resilient portion 102 to move or elastically deform relative to the base 108. Thus, the stem 116 cooperates with the resilient portion 102 to enable each of the first, biasing clips 82 to elastically deform relative to the base 108. With reference to FIG. 4, the stem 116 generally extends for a distance that enables the contact surface 118 to bear against a respective one of the tabs 50. The stem 116 is interconnected to the contact surface 118 via a curved or arcuate surface 120. The contact surface 118 is slightly rounded to reduce contact stresses between the respective one of the first, biasing clips 82 and the respective one of the tabs 50. The contact surface 118 contacts and biases against the first surface 54 of the respective tab 50.

Figure 9:
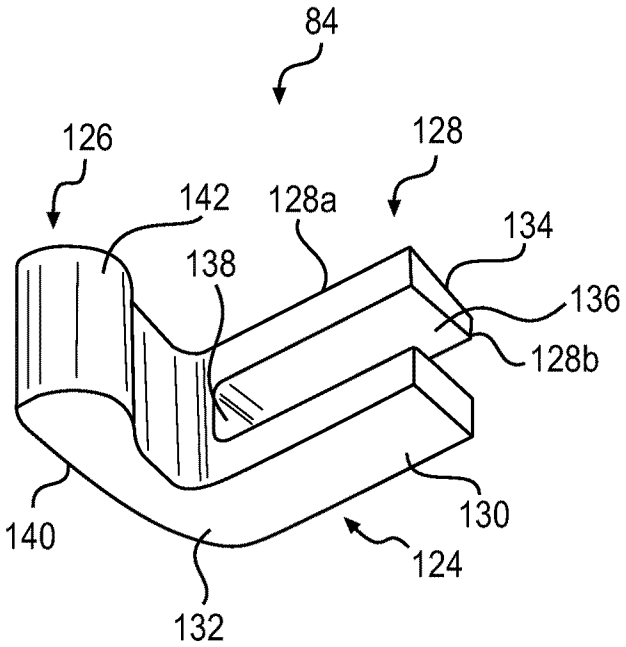
FIG. 9 is a second perspective view of the second, bumper clip.
Figure 8:
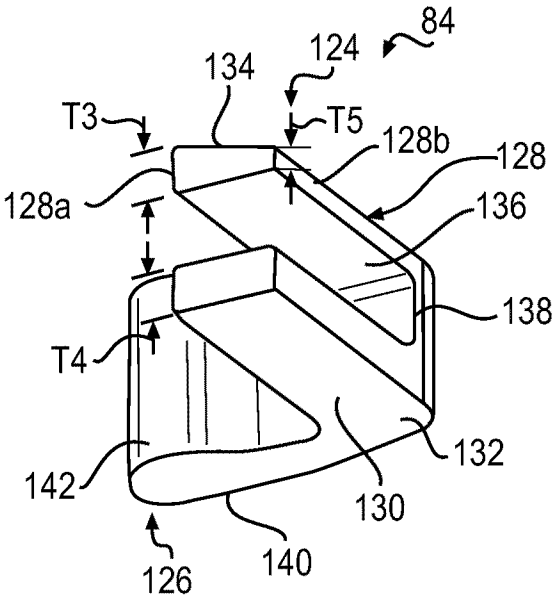
FIG. 8 is a first perspective view of a second, bumper clip of the compliant coupling system of FIG. 1 in accordance with the present disclosure.

Each of the second, bumper clips 84 cooperates with the retaining ring 80 and a respective one of the tabs 50 to couple the shroud 16 to the engine casing 14, and is substantially rigid. Generally, each of the second, bumper clips 84 are coupled to the retaining ring 80 such that the direction of rotation of rotor blades 24 would provide mechanical loads onto the second, bumper clips 84 against the retaining ring 80 if a blade tip rub were to be encountered. Each of the second, bumper clips 84 is generally not deformable, and provides a rigid stop to maintain concentricity of the shroud 16 during thermal growth. Generally, for each one of the plurality of tabs 50 and for each one of the plurality of notches 90, there is a respective one of the second, bumper clips 84. Stated another way, a single second, bumper clip 84 is received in the coupling channel 92 and extends into the associated one of the notches 90 to contact a respective one of the tabs 50. Each of the second, bumper clips 84 may be composed of any suitable material, such as a metal, metal alloy, etc. In one example, each of the second, bumper clips 84 is composed of a cobalt based metal alloy, and is formed through a wire electrical discharge machining (EDM) process. With reference to FIGS. 8 and 9, each of the second, bumper clips 84 includes a second body 124 and a bumper portion 126.

The second body 124 defines a third leg 128 and a fourth leg 130, which extend outwardly from a base 132. The third leg 128 may have a third thickness T3, which may be different than a fourth thickness T4 of the fourth leg 130 (FIG. 8). In one example, the third thickness T3 is less than the fourth thickness T4. Moreover, the thickness T3 of the third leg 128 may vary along a height of the third leg 128, such that a thickness T5 of the third leg 128 is different than the third thickness T3. In this regard, the third leg 128 may include a sloped or tapered surface 134, which may taper from a first side 128*a* to a second side 128*b* of the third leg 128. The tapered surface 134 may provide clearance between each of the second, bumper clips 84 and the nozzle 6.

The third leg 128 and the fourth leg 130 extend from the base 132 for substantially the same distance, however, one of the third leg 128 and the fourth leg 130 may have a different length than the other, if desired. A recess 136 is defined between the third leg 128 and the fourth leg 130 such that the third leg 128 is spaced apart from the fourth leg 130. The third leg 128 is slidably received with the inner diameter surface 86*a* and the fourth leg 130 is slidably received along the coupling channel 92 to couple the second body 124 to the coupling channel 92 so that each of the second, bumper clips 84 is movable within the coupling channel 92. The recess 136 is generally sized to receive a portion of the retaining ring 80, with a wall 138 of the base 132 providing a stop that contacts the surface 80*b* of the retaining ring 80 (FIG. 4) to prevent further advancement of each of the second, bumper clips 84 in the coupling channel 92. Thus, the third leg 128 and the fourth leg 130 of the second body 124 are spaced apart to receive a portion of the retaining ring 80 there between to movably couple the second, bumper clips 84 to the retaining ring 80.

The base 132 is coupled to the third leg 128, the fourth leg 130 and the bumper portion 126. The base 132 includes the wall 138. The bumper portion 126 is substantially rigid, and includes a bumper contact surface 140 and a rounded portion 142. The bumper contact surface 140 is coupled to the base 132, and extends upwardly away from the base 132. With reference to FIG. 4, the bumper contact surface 140 generally extends for a distance that enables the bumper contact surface 140 to bear against a respective one of the tabs 50. In one example, the bumper contact surface 140 contacts the second surface 56 of the respective tab 50. The bumper contact surface 140 is slightly rounded to reduce contact stresses between each of the second, bumper clips 84 and the respective one of the tabs 50.

The rounded portion 142 provides structural rigidity to the bumper portion 126. The rounded portion 142 contacts a surface 80*b* of the retaining ring 80 adjacent to the respective one of the notches 90 when each of the second, bumper clips 84 is received within the coupling channel 92.

Figure 10:
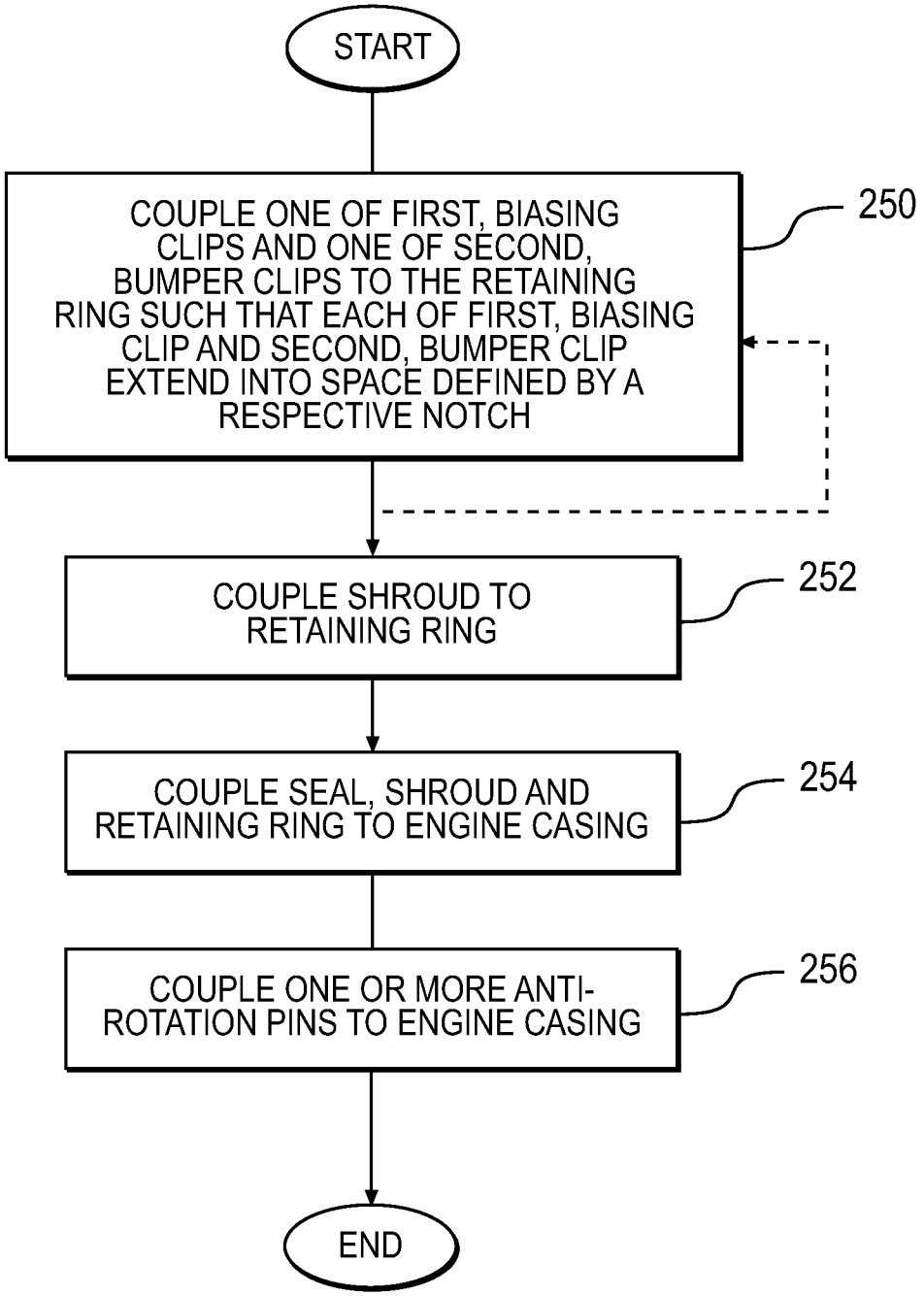
FIG. 10 is a flow chart illustrating an exemplary method for coupling the shroud to the engine casing with the compliant coupling system in accordance with various embodiments.

In order to couple the shroud 16 to the engine casing 14, in one example, with reference to FIGS. 4 and 10, for each of the notches 90, a respective one of the plurality of first, biasing clips 82 and a respective one of the second, bumper clips 84 may be coupled to the retaining ring 80 (FIG. 10; block 250). In one example, the respective one of the second, bumper clips 84 may be inserted into the coupling channel 92 such that a portion of the respective one of the second, bumper clips 84 extend into the space defined by a respective one of the notches 90 of the retaining ring 80. The respective one of the first, biasing clips 82 may be inserted into the coupling channel 92 such that a portion of the respective one of the first, biasing clips 82 extend into the space defined by the respective one of the notches 90. This process may be repeated until a respective one of the first, biasing clips 82 and a respective one of the second, bumper clips 84 is associated with each one of the notches 90 to create a first subassembly. The shroud 16 may be coupled or pushed into the assembly of the retaining ring 80, the first, biasing clips 82 and the second, bumper clips 84 (FIG. 10; block 252) to create a second subassembly. Generally, the shroud 16 is coupled to the retaining ring 80 such that each of the tabs 50 of the shroud 16 reside between respective ones of the first, biasing clips 82 and the second, bumper clips 84 with the first surface 54 of each of the tabs 50 resting on or coupled to the contact surface 118 of each of the first, biasing clips 82 and the second surface 56 of each of the tabs 50 resting on or coupled to the bumper contact surface 140 of each of the second, bumper clips 84.

With reference to FIGS. 3 and 10, the seal 20 and the second subassembly of the shroud 16 and the retaining ring 80 may be coupled to the engine casing 14 (FIG. 10; block 254). The seal 20 is positioned adjacent to the surface 34 of the engine casing 14 and the second subassembly of the shroud 16 and the retaining ring 80. The one or more anti-rotation pins 18 are coupled to the engine casing 14 (FIG. 10; block 256). The one or more anti-rotation pins 18 may be inserted through the alignment bores 30 of the engine casing 14 and the plurality of bores 60 to couple the retaining ring 80 to the engine casing 14.

Thus, the compliant coupling system 22 couples the shroud 16 to the engine casing 14, while allowing radial compliance through the use of the first, biasing clips 82 and the second, bumper clips 84. The first, biasing clips 82 and the second, bumper clips 84 enable the shroud 16 to slide radially, which provides the radial compliance while maintaining concentricity or center control relative to the centerline C (FIG. 3). In addition, the first, biasing clips 82 and the second, bumper clips 84 each include rounded contact surfaces, which reduce contact stresses between the shroud 16, the first, biasing clips 82 and the second, bumper clips 84. By securing the first, biasing clips 82, the second, bumper clips 84 and the retaining ring 80 within a clearance defined axially within the engine casing 14, the compliant coupling system 22 does not increase the radial height of the engine casing 14. Moreover, the use of the first, biasing clips 82 and the second, bumper clips 84 may reduce the need for tight tolerances between the tabs 50 of the shroud 16 and the notches 90 of the retaining ring 80 as the first, biasing clips 82 are elastically deformable to account for part variations, which reduces manufacturing costs.

Figure 11:
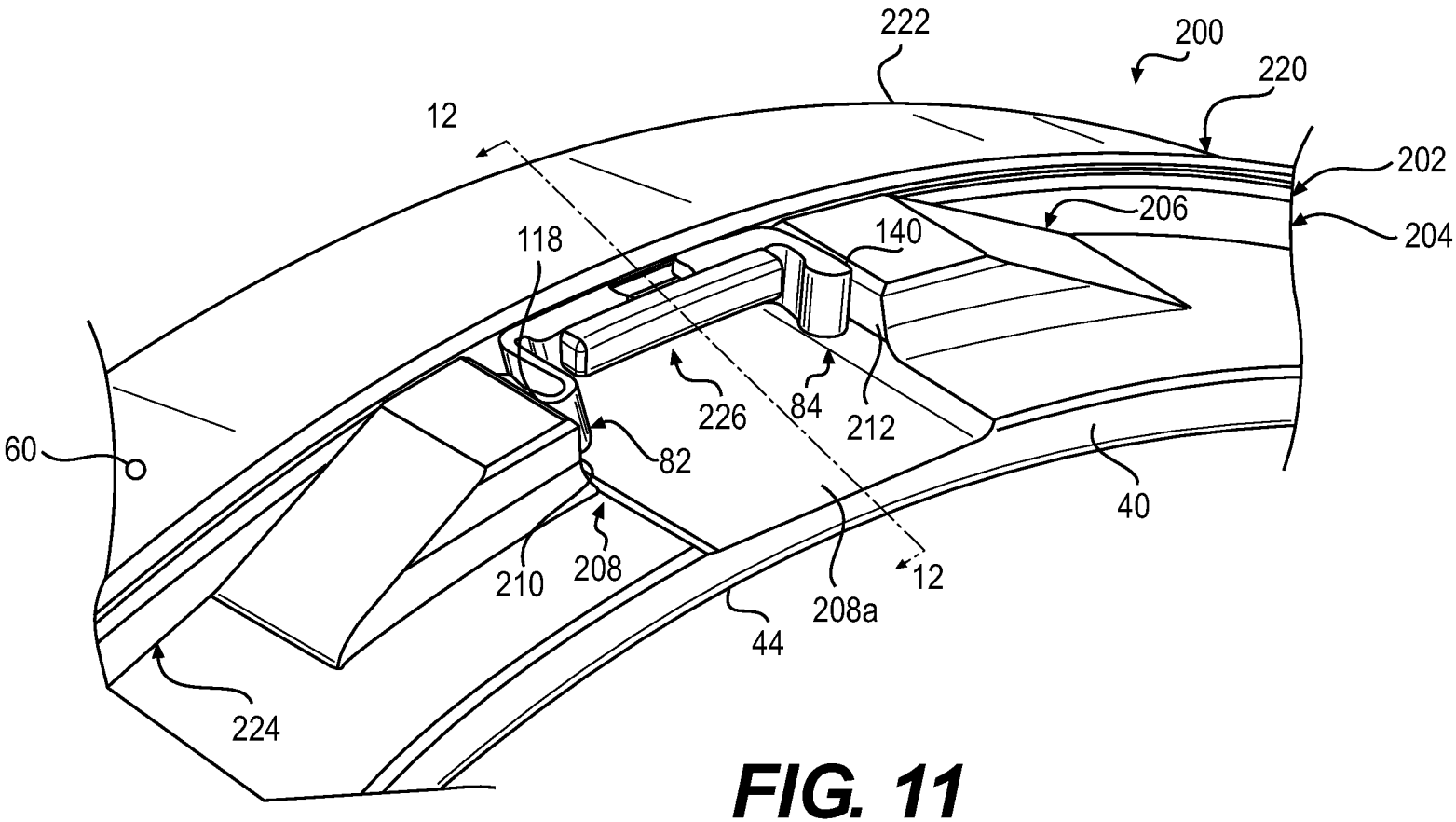
FIG. 11 is a perspective view of a portion of a compressor or turbine of a gas turbine engine, which includes a compliant coupling system for coupling a shroud to an engine casing in accordance with various embodiments.
Figure 12:
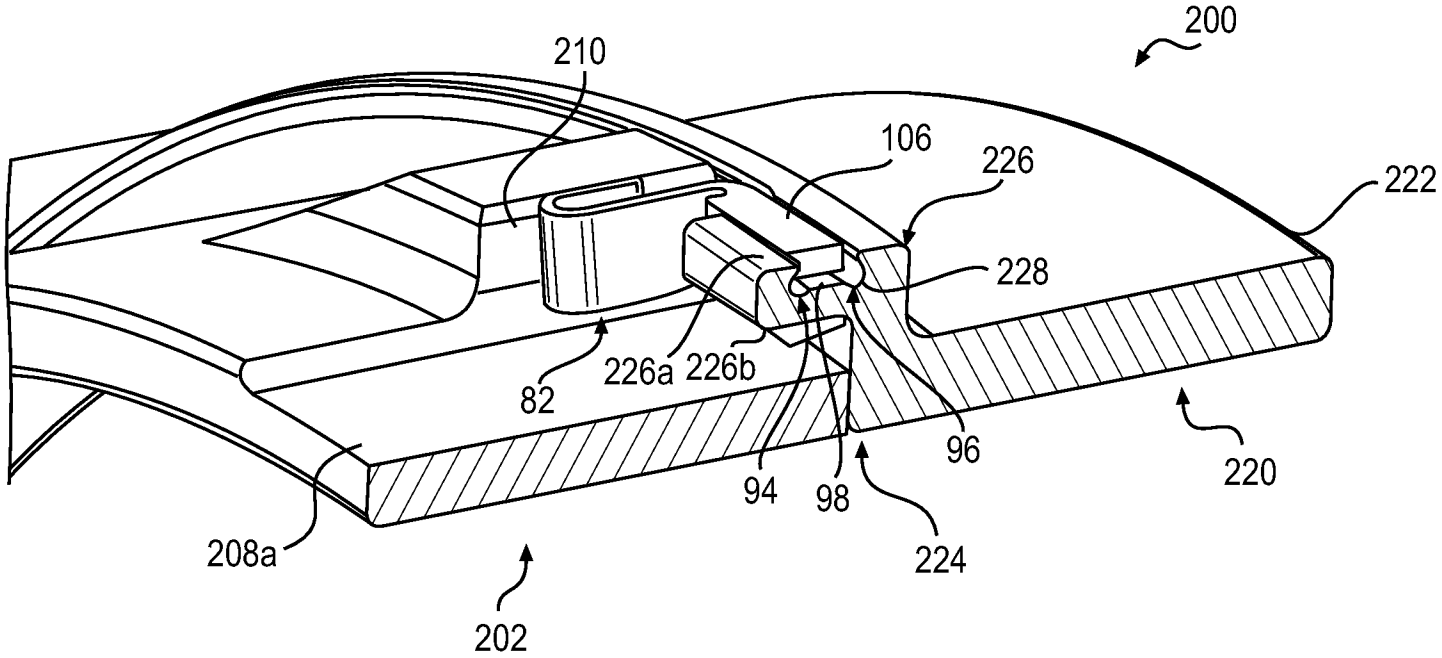
FIG. 12 is a cross-sectional view of a portion of the compliant coupling system of FIG. 11, taken along line 12-12 of FIG. 11.

With reference now to FIGS. 11 and 12, a schematic illustration of another exemplary compliant coupling system 200 is shown. The exemplary compliant coupling system 200 couples a shroud 202 to an engine casing, such as the engine casing 14, discussed with regard to FIGS. 1-10 with radial compliance. For clarity, in this example, the engine casing 14 is not shown, with the understanding that the compliant coupling system 200 couples the shroud 202 to the engine casing 14 as discussed herein above with regard to FIGS. 1-10. As the compliant coupling system 200 may be similar to the compliant coupling system 22 discussed with regard to FIGS. 1-10, only the differences between the compliant coupling system 200 and the compliant coupling system 22 will be discussed in detail herein, with the same reference numerals used to denote the same or substantially similar components. Similar to the compliant coupling system 22, the compliant coupling system 200 may be employed with a gas turbine engine to couple the shroud 202 to the engine casing 14 associated with the gas turbine engine, while providing radial compliance. Although not illustrated herein, the one or more anti-rotation pins 18 and the seal 20 may be employed with the compliant coupling system 200 and the shroud 202.

In this example, the shroud 202 may be composed of any suitable material, such as a metal, metal alloy, composite, etc. In one example, the shroud 202 is composed of a ceramic based material, which may have a thermal growth rate that is different than a thermal growth rate associated with the engine casing. The shroud 202 is substantially annular, and includes the first end 40 and a second end 204. The shroud 202 also defines the throughbore 44. The second end 204 of the shroud 202 includes a plurality of projecting flanges 206. Each of the plurality of projecting flanges 206 extends radially outward from the second end 204 of the shroud 202. The plurality of projecting flanges 206 are spaced about a perimeter or circumference of the shroud 202. Each of the projecting flanges 206 defines a slot 208. It should be noted that while the shroud 202 is illustrated and described herein as including the plurality of projecting flanges 206, the shroud 202 may include a single projecting flange, through which a plurality of slots 208 are defined. Thus, the following description is merely an example.

Moreover, while the shroud 202 is described herein as including a plurality of slots 208, it will be understood that the shroud 202 may include any desired relief that accommodates the compliant coupling system 200. For example, with brief reference to FIG. 11A, a shroud 302 may include one or more cut-outs 300, which may receive the compliant coupling system 200.

With reference back to FIG. 11, the slot 208 is defined through each of the projecting flanges 206 to create a first contact surface 210 and a second contact surface 212. Thus, the slots 208 are spaced about a perimeter or circumference of the shroud 202. In one example, the shroud 202 comprises at least three slots 208, but the shroud 202 may comprise any number of slots 208, such as five, seven or more. Generally, the shroud 202 comprises at least three slots 208 to ensure concentricity of the shroud 202 within the engine casing. Generally, each of the slots 208 has substantially the same shape, however, it should be understood that one or more of the slots 208 may have a different shape, if desired.

The first contact surface 210 is defined generally opposite the second contact surface 212. The first contact surface 210 is spaced apart from the second contact surface 212 such that a portion of the compliant coupling system 200 may be received within the slot 208 to contact the first contact surface 210 and the second contact surface 212. The first contact surface 210 and the second contact surface 212 extend upward or radially outward from a surface 208*a* of the slot 208 so as to receive the portion of the compliant coupling system 200 therein.

The compliant coupling system 200 couples the shroud 202 to the engine casing (not shown). In one example, the compliant coupling system 200 includes a retaining ring 220, the plurality of first, biasing clips 82 and the plurality of second, bumper clips 84. The retaining ring 220, the plurality of first, biasing clips 82 and the plurality of second, bumper clips 84 cooperate to secure the shroud 202 to the engine casing 14 axially to enable radial compliance between the shroud 202 and the engine casing.

The retaining ring 220 is annular and is received within the engine casing. The retaining ring 220 is composed of a suitable metal, metal alloy, composite, etc. In one example, the retaining ring 220 is composed of a metal alloy. The retaining ring 220 includes a first end 222, a second end 224, three or more tabs 226 and the plurality of bores 60. A throughbore is also defined through the retaining ring 220, which enables the retaining ring 220 to be positioned about a plurality of rotor blades (not shown). The plurality of bores 60 are defined through the retaining ring 200 to receive respective ones of the one or more anti-rotation pins 18. The plurality of bores 60 are generally cylindrical, however, the plurality of bores 60 may have any desired shape to cooperate with the one or more anti-rotation pins 18.

The first end 222 is generally opposite the second end 224. The second end 224 comprises includes the three or more tabs 226. The three or more tabs 226 extend outwardly from the second end 224. Generally, the retaining ring 220 includes a number of tabs 226, which correspond to the number of slots 208 of the shroud 202. Generally, a respective one of the tabs 226 is received within a respective one of the slots 208. Each of the tabs 226 generally extend for a distance less than a width of the slot 208 such that a respective one of the first, biasing clips 82 and a respective one of the second, bumper clips 84 may be received on either side of a tab 226.

With reference to FIGS. 11 and 12, each of the tabs 226 includes a coupling channel 228. The coupling channel 228 receives the second leg 106 of a respective one of the first, biasing clips 82 and the fourth leg 130 of a respective one of the second, bumper clips 84. Thus, the first, biasing clips 82 and the second, bumper clips 84 are coupled to the retaining ring 220 such that a portion of a respective one of the tabs 226 is received between the first leg 104 and the second leg 106 of the first, biasing clip 82, and the third leg 128 and the fourth leg 130 of the second, bumper clip 84. Generally, the coupling channel 228 extends along a first surface 226*a* of each of the tabs 226; however, the coupling channel 228 may extend along both the first surface 226*a* and a second surface 226*b* of each of the tabs 226.

The coupling channel 228 includes the first coupling groove 94, the second coupling groove 96 and the raised surface 98. The first coupling groove 94, the second coupling groove 96 and the raised surface 98 cooperate to define a substantially W-shape. It should be noted, however, that the coupling channel 228 may have any desired shape to facilitate the movable or slideable engagement of the first, biasing clips 82 and the second, bumper clips 84 with the tabs 226.

Figure 11A:
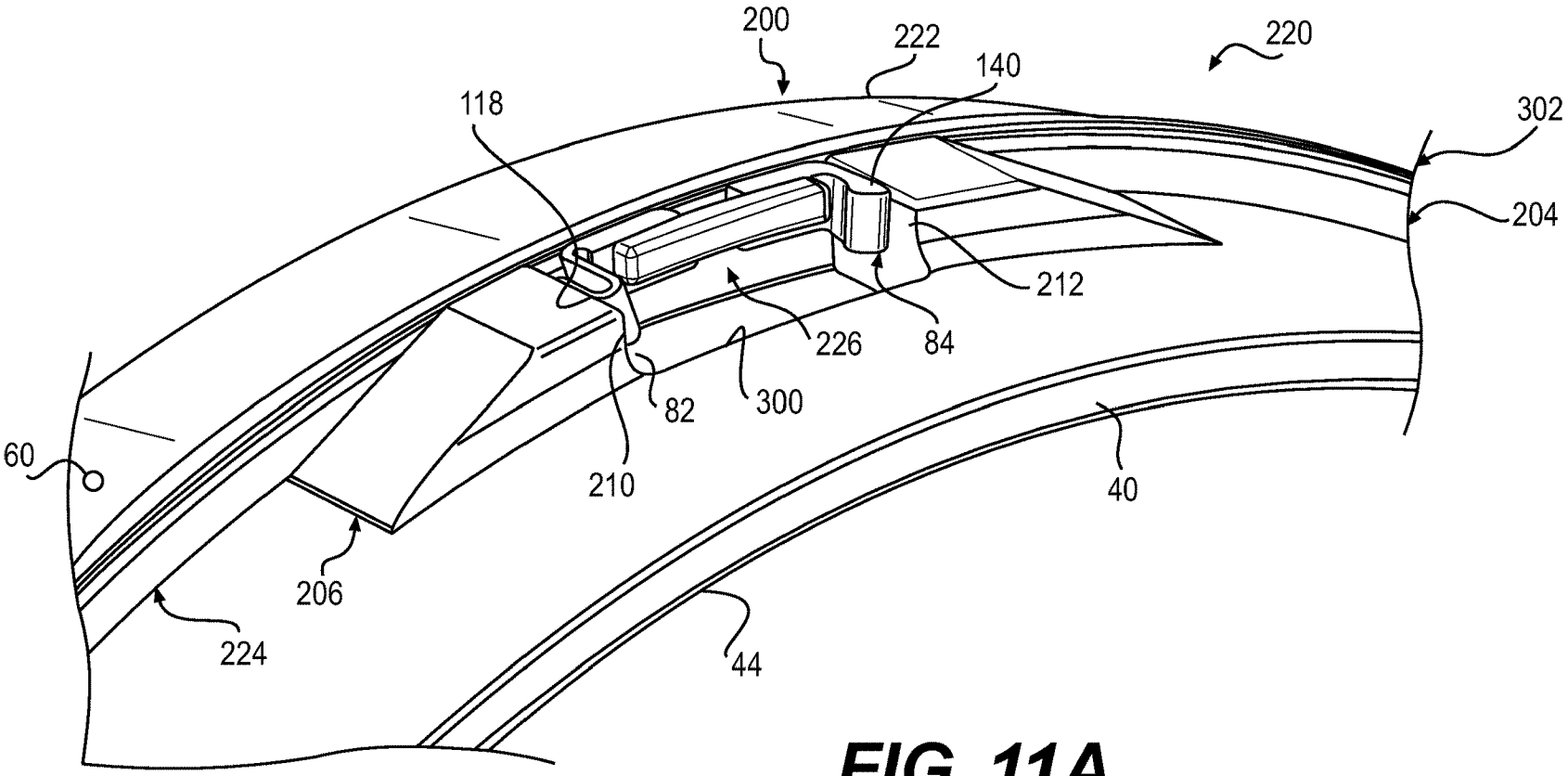
FIG. 11A is a perspective view of a portion of a compressor or turbine of a gas turbine engine, which includes a compliant coupling system for coupling a shroud to an engine casing in accordance with various embodiments.

In order to couple the shroud 202 to the engine casing, in one example, a respective one of the plurality of first, biasing clips 82 and a respective one of the second, bumper clips 84 may be coupled to the retaining ring 220. In one example, the respective one of the second, bumper clips 84 may be inserted into the coupling channel 228 of the respective tab 226. The respective one of the first, biasing clips 82 may be inserted into the coupling channel 228 of the respective tab 226. This process may be repeated until a respective one of the first, biasing clips 82 and a respective one of the second, bumper clips 84 is associated with each one of the tabs 226 to create a first subassembly. The shroud 202 may be coupled to or pushed into the retaining ring 220 such that a respective one of the slots 208 is aligned with a respective one of the tabs 226; and the contact surface 118 contacts the first contact surface 210 of the respective slot 208 (or cut-outs 300; FIG. 11A) and the bumper contact surface 140 contacts the second contact surface 212 of the respective slot 208 (or cut-outs 300; FIG. 11A) to create a second subassembly.

The seal 20 and the second subassembly of the shroud 202 and the retaining ring 80 may be coupled to the engine casing 14. The seal 20 is positioned adjacent to the surface 34 of the engine casing 14 and the second subassembly of the shroud 16 and the retaining ring 220. The one or more anti-rotation pins 18 are coupled to the engine casing 14. The one or more anti-rotation pins 18 may be inserted through the alignment bores 30 of the engine casing 14 and the plurality of bores 60 to couple the retaining ring 220 to the engine casing 14.

As used herein, the term "axial" refers to a direction that is generally parallel to an axis of rotation, axis of symmetry, or centerline of a component or components. For example, in a cylinder or disc with a centerline and opposite, generally circular ends or faces, the "axial" direction may refer to the direction that generally extends in parallel to the centerline between the opposite ends or faces. In certain instances, the term "axial" may be utilized with respect to components that are not cylindrical (or otherwise radially symmetric). For example, the "axial" direction for a rectangular housing containing a rotating shaft may be viewed as a direction that is generally in parallel with the rotational axis of the shaft. Furthermore, the term "radially" as used herein may refer to a direction or a relationship of components with respect to a line extending outward from a shared centerline, axis, or similar reference, for example in a plane of a cylinder or disc that is perpendicular to the centerline or axis. In certain instances, components may be viewed as "radially" aligned even though one or both of the components may not be cylindrical (or otherwise radially symmetric). Furthermore, the terms "axial" and "radial" (and any derivatives) may encompass directional relationships that are other than precisely aligned with (e.g., oblique to) the true axial and radial dimensions, provided the relationship is predominately in the respective nominal axial or radial direction.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A compliant coupling system for coupling a shroud to an engine casing, comprising:

a retaining ring adapted to be positioned adjacent to the shroud and adapted to be coupled to the engine casing, the retaining ring defining a coupling channel about a circumference of the retaining ring and at least one notch that interrupts the coupling channel;

a first clip received within the coupling channel and having a biasing portion that extends into a space defined by the at least one notch, the biasing portion adapted to contact the shroud, the first clip includes a first base, with a first leg and a second leg each extending outwardly from the first base and spaced apart from each other, and one of the first leg and the second leg is received within the coupling channel; and a second clip received within the coupling channel and having a bumper portion that extends into the space defined by the at least one notch, the bumper portion adapted to contact the shroud.

2. The system of claim 1, wherein the and the biasing portion is coupled to the first base via a groove.

3. The system of claim 1, wherein the second clip includes a second base, and the bumper portion is coupled to the second base so as to extend outwardly from the second base.

4. The system of claim 1, wherein the second clip includes a second base, with a third leg and a fourth leg each extending outwardly from the second base and spaced apart from each other, and one of the third leg and the fourth leg is received within the coupling channel.

5. The system of claim 1, wherein the biasing portion is substantially U-shaped.

6. The system of claim 1, further comprising the shroud, wherein the shroud includes at least three tabs along a perimeter of the shroud and the at least one notch comprises at least three notches, with a respective one of the at least three tabs received within a respective one of the at least three notches.

7. The system of claim 6, wherein the biasing portion biases against a first surface of a respective one of the at least three tabs, and the bumper portion contacts a second surface of the respective one of the at least three tabs.

8. A method for coupling a shroud to an engine casing, comprising:

coupling a retaining ring defining a coupling channel about a circumference of the retaining ring and at least three notches that interrupt the coupling channel to the engine casing, each of the at least three notches defining a space;

coupling a first clip to the retaining ring such that a portion of the first clip extends into the space defined by a respective one of the at least three notches, the first clip including a first leg and a second leg each spaced apart from each other, and the coupling the first clip to the retaining ring including positioning one of the first leg and the second leg within the coupling channel;

coupling a second clip to the retaining ring such that a portion of the second clip extends into the space defined by the respective one of the at least three notches; and coupling the shroud including at least three tabs to the retaining ring such that each of the at least three tabs is substantially aligned with a respective one of the at least three notches and a respective one of the at least three tabs is coupled to the portion of the first clip and the portion of the second clip.

9. The method of claim 8, further comprising:

coupling a seal to the engine casing, with the seal positioned between a portion of the engine casing and the shroud.

10. The method of claim 8, wherein coupling the first clip to the retaining ring further comprises:

sliding a portion of a base of the first clip into the coupling channel defined in the retaining ring so that a biasing portion of the first clip extends into the space defined by the respective one of the at least three notches and biases against the respective one of the at least three tabs.

11. The method of claim 8, wherein coupling the second clip to the retaining ring further comprises:

sliding a portion of a base of the second clip into the coupling channel defined in the retaining ring so that a bumper portion of the second clip extends into the space defined by the respective one of the at least three notches and contacts the respective one of the at least three tabs.

12. A gas turbine engine, comprising:

an engine casing;

an annular shroud received within the engine casing, the shroud including at least one tab extending axially from the shroud;

a compliant coupling system that couples the shroud to the engine casing, the compliant coupling system including:

a retaining ring defining a coupling channel about a circumference of the retaining ring and at least one notch that interrupts the coupling channel, the retaining ring coupled to the engine casing adjacent to the shroud such that the at least one tab is received in a space defined by the at least one notch;

a first clip having a first base and a biasing portion coupled to the first base, a portion of the first base received within the coupling channel such that the biasing portion extends into the space defined by the at least one notch and contacts the at least one tab; and a second clip having a second base and a bumper portion coupled to the second base, a portion of the second base received within the coupling channel such that the bumper portion extends into the spaced defined by the at least one notch and contacts the at least one tab, wherein each of the first base and the second base include a pair of legs, and one leg of each of the pair of legs is slidably received within the coupling channel.

13. The gas turbine engine of claim 12, further comprising a seal coupled to the engine casing so as to be positioned between the shroud and an internal flange of the engine casing.

14. The gas turbine engine of claim 13, wherein the shroud defines a projecting flange, and the seal is positioned between a first surface of the projecting flange and the internal flange of the gas turbine engine.

15. The gas turbine engine of claim 14, wherein the at least one tab extends from a second surface of the projecting flange, and the second surface is substantially opposite the first surface.

16. The gas turbine engine of claim 12, further comprising at least one anti-rotation pin that couples the retaining ring to the engine casing.

17. The gas turbine engine of claim 12, wherein the first base is coupled to the biasing portion via a groove.

18. The gas turbine engine of claim 12, wherein the shroud comprises at least three tabs, the retaining ring comprises at least three notches and the compliant coupling system comprises at least three pairs of the first clips and the second clips.

* * * * *